US011982154B2

(12) United States Patent
Ferreira Da Silva et al.

(10) Patent No.: US 11,982,154 B2
(45) Date of Patent: May 14, 2024

(54) COOLING SYSTEM FOR DOWNHOLE ELECTRONIC DEVICE

(71) Applicant: PETRÓLEO BRASILEIRO S.A.—PETROBRÁS, Rio de Janeiro (BR)

(72) Inventors: Mario Germino Ferreira Da Silva, Rio de Janeiro (BR); Paulo Guilherme Oliveira De Oliveira, Rio de Janeiro (BR)

(73) Assignee: PETRÓLEO BRASILEIRO S.A.-PETROBRÁS, Rio De Janeiro (BR)

( * ) Notice: Subject to any disclaimer, the term of this patent is extended or adjusted under 35 U.S.C. 154(b) by 97 days.

(21) Appl. No.: 17/624,463

(22) PCT Filed: Jun. 30, 2020

(86) PCT No.: PCT/BR2020/050233
§ 371 (c)(1),
(2) Date: Jan. 3, 2022

(87) PCT Pub. No.: WO2021/000034
PCT Pub. Date: Jan. 7, 2021

(65) Prior Publication Data

US 2022/0356785 A1 Nov. 10, 2022

(30) Foreign Application Priority Data

Jul. 4, 2019 (BR) ..... 102019013939-0

(51) Int. Cl.
*E21B 36/00* (2006.01)
*F28D 7/02* (2006.01)

(52) U.S. Cl.
CPC ..... *E21B 36/001* (2013.01); *F28D 7/02* (2013.01)

(58) Field of Classification Search
CPC ..... E21B 36/001; E21B 47/0175; F28D 7/02; F28D 7/024
See application file for complete search history.

(56) References Cited

U.S. PATENT DOCUMENTS 4,407,136 A * 10/1983 de Kanter ..... G06F 1/20 62/51.1
6,072,814 A 6/2000 Ryan et al.
(Continued)

FOREIGN PATENT DOCUMENTS

CN 113236126 A * 8/2021 ..... E21B 21/16
WO WO-2004003506 A2 * 1/2004 ..... E21B 41/0064

OTHER PUBLICATIONS

International Preliminary Examination Report PCT/IPEA/408, issued in PCT/BR2020/050233, dated Jul. 5, 2021.
(Continued)

*Primary Examiner* — Jennifer H Gay
(74) *Attorney, Agent, or Firm* — Birch, Stewart, Kolasch & Birch, LLP

(57) ABSTRACT

The present invention is related to cooling systems for electronic devices used in downhole operations. In this scenario, the present invention provides a downhole electronic device cooling system comprising a first heat exchanger element (1) internal to a heat exchanger vessel (3), and a second heat exchanger element (2) associated with the electronic device (4), wherein the first (1) and second (2) heat exchanger elements are in fluid communication by a cooling fluid, wherein the heat exchanger vessel (3) allows the circulation of a secondary cooling fluid.

16 Claims, 1 Drawing Sheet

(56) References Cited

U.S. PATENT DOCUMENTS 6,769,487 B2 * 8/2004 Hache ..... E21B 47/017 166/57
9,732,605 B2 * 8/2017 Winslow ..... E21B 47/0175
10,012,054 B2 * 7/2018 Ciglenec ..... E21B 47/017
11,371,338 B2 * 6/2022 Alexeyenko ..... E21B 47/0175
11,441,416 B2 * 9/2022 Adebiyi ..... E21B 47/07
2004/0112601 A1 * 6/2004 Hache ..... E21B 47/017 166/57
2007/0267220 A1 11/2007 Magiawala et al.
2011/0079391 A1 * 4/2011 Bedouet ..... E21B 47/0175 166/57
2011/0146967 A1 * 6/2011 Winslow ..... E21B 47/017 166/57
2012/0195334 A1 8/2012 Wilkiel et al.
2012/0297801 A1 * 11/2012 Sun ..... E21B 36/001 62/127
2015/0000899 A1 * 1/2015 DiFoggio ..... E21B 47/017 166/57
2015/0345254 A1 * 12/2015 Ciglenec ..... E21B 47/07 166/57
2016/0130913 A1 * 5/2016 Hatton ..... E21B 36/001 166/57
2016/0273309 A1 * 9/2016 Maher ..... E21B 47/017
2018/0230793 A1 * 8/2018 Kusmer ..... F04B 39/06
2018/0347336 A1 * 12/2018 Kusmer ..... E21B 47/0175
2019/0345822 A1 * 11/2019 Pfutzner ..... G01J 3/44
2021/0246779 A1 * 8/2021 Adebiyi ..... E21B 49/00
2021/0372268 A1 * 12/2021 Alexeyenko ..... E21B 36/001
2022/0356785 A1 * 11/2022 Ferreira Da Silva ..... E21B 36/001
2022/0400577 A1 * 12/2022 Smith ..... H05K 7/20236

OTHER PUBLICATIONS

International Preliminary Examination Report PCT/IPEA/409, issued in PCT/BR2020/050233, dated Oct. 22, 2021.
International Search Report (PCT/ISA/210) issued in PCT/BR2020/050233 mailed on Aug. 28, 2020.
Written Opinion (PCT/ISA/237) issued in PCT/BR2020/050233 mailed on Aug. 28, 2020.

* cited by examiner

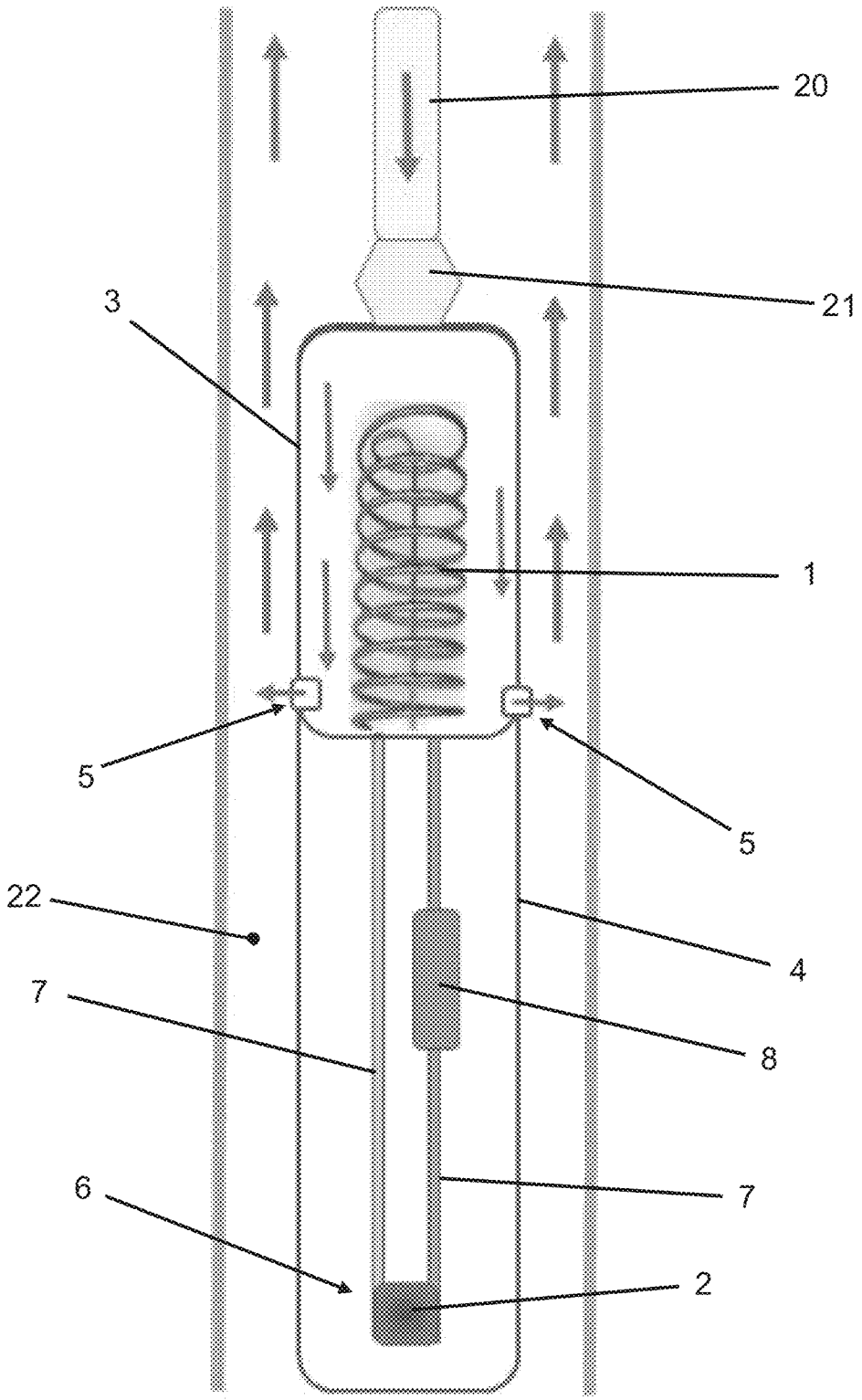
20
21
3
1
5
5
22
4
7
8
6
7
2

COOLING SYSTEM FOR DOWNHOLE ELECTRONIC DEVICE

FIELD OF THE INVENTION

The present invention is related to cooling systems for electronic devices used in downhole operations.

BACKGROUND OF THE INVENTION

Several electronic devices used in downhole operations produce a high amount of heat during their operation. Often, the amount of heat generated is so high that it can cause damage to the electronic device itself, or to elements associated with it.

In particular, laser perforating gun systems need to be cooled so that their operation does not suffer failures due to the high operating temperatures. Thus, the difficulty in cooling these laser perforating gun systems makes it difficult, and even prevents, their use in well drilling and perforating operations.

Thus, a cooling system is necessary to exchange heat between the electronic device and the environment external to the tool, when such devices need cooling so that they present adequate efficiency and have a minimum lifetime for the performance of various operations.

Due to the nature and environment of the operation, laser tools, for example, are exposed to high external temperatures inside the well, where it can easily exceed 120° C. In addition, inside the tool there are also some heat sources such as energy dissipated by electronic circuits, the absorption of a small fraction of light energy by the lenses, in addition to the assembly of the laser emitter device which can dissipate something around 4 kW.

Thus, it is necessary that the cooling system maintains its temperature around 30° C., which is an acceptable temperature for both the laser devices, as well as the entire internal environment of the tool to ensure an environment with suitable working temperature for electronic and optical components.

In addition, an important aspect is the thermal insulation and cooling of laser emitting devices. Such devices have, on average, an electro-optical conversion efficiency of approximately 50%, thus, to generate 4 kW of optical power, an electrical power of approximately 8 kW is needed, where half is transformed into heat that must be dissipated, otherwise the laser device is damaged.

However, despite the knowledge of the need for cooling laser devices, the current state of the art is not about cooling systems for laser emitting devices, as will be evident from the documents listed below.

Documents WO2014089544A2, U.S. Pat. No. 9,168,612B2, US20100078414A1 US20070267220A1, and U.S. Pat. No. 8,678,087B2 disclose different configurations of laser emitting devices used in downhole operations that describe the need to adopt a cooling system for laser emitting devices. However, none of the documents listed provide details about the refrigeration systems.

The documents U.S. Pat. No. 7,720,323B2, and U.S. Pat. No. 9,217,291B2 are directed to laser emitting devices that are specifically designed not to need cooling systems for these elements.

US20160151810A1 discloses a method for heating a conduit to remove the methane hydrate deposit on the seabed, which involves directing a blue light laser from a submersible apparatus to impact the outer surface of the fluid conduit to irradiate the conduit.

This document further discloses the use of a complex laser emitter device cooling system to ensure its correct functioning.

Document US20080134508A1 in turn, discloses a method to form grooves in conduits for oil exploration, wherein the method comprises the use of lasers in a refrigerated system.

As described in US20080134508A1, cooling is done on its external surface by means of cooled air that is sprayed by tube systems with holes, parallel to its length, and is internally cooled by means of compressed air.

Thus, the state of the art, despite recognizing the importance and the need to cool the laser emission systems used in downhole operations, does not deal with cooling systems applied to these situations. More generally, the state of the art does not deal with cooling systems applied to various electronic devices used in downhole operations.

In particular, the systems currently known are complex and, therefore, are subject to operation failures, putting at risk the integrity of electronic devices, such as laser emitting equipment, causing serious damage to the industry.

Therefore, the state of the art still lacks simple and reliable systems for cooling electronic devices used in downhole operations.

As will be further detailed below, the present invention aims to solve the problems of the state of the art described above in a practical and efficient manner.

SUMMARY OF THE INVENTION

The purpose of the present invention is to provide a cooling system for electronic devices for operations in wens that is simple to operate and reliable.

In order to achieve the above-described object, the present invention provides a downhole electronic device cooling system comprising a first heat exchanger element internal to a heat exchanger vessel, and a second heat exchanger element associated with the electronic device, wherein the first and second heat exchanger elements are in fluid communication by a cooling fluid, wherein the heat exchanger vessel allows the circulation of a secondary cooling fluid.

BRIEF DESCRIPTION OF THE FIGURES

The detailed description presented below refers to the attached FIG. and their respective reference numbers.

FIG. 1 illustrates a schematic diagram of the downhole electronic device cooling system according to a preferred embodiment of the present invention.

DETAILED DESCRIPTION OF THE INVENTION

Preliminarily, it should be noted that the description that follows will depart from a preferred embodiment of the invention. As will be apparent to one skilled in the art, however, the invention is not limited to that particular embodiment.

FIG. 1 illustrates a schematic diagram of the downhole electronic device cooling system according to a preferred embodiment of the present invention. It is observed that the downhole electronic device cooling system comprises a first heat exchanger element 1 internal to a heat exchanger vessel 3, and a second heat exchanger element 2 associated with the electronic device 4, wherein the first 1 and the second 2 heat exchangers are in fluid communication by a cooling fluid, and wherein the heat exchanger vessel 3 allows circulation of a secondary cooling fluid.

Optionally, the electronic device 4 used and illustrated in the example of FIG. 1 is a laser device 4 for performing laser perforation. However, it is emphasized that the electronic device 4 can be any electronic device used in downhole operations. Thus, although the illustrated optional configuration is directed to a laser device comprising a laser emitting diode, the invention is not restricted to that particular configuration.

As can be seen, the system of the present invention is positioned in the annulus 22 of a well and connected to the lower end of a flexitube 20 through a connecting means 21.

The flexitube 20 consists of a flexible steel tube with a diameter ranging from 1¼" to 2⅞". It is commonly used for oil well operations, as it can be lowered into the well, directly into the casing or through the interior of the production column. It can support loads and transport them, and is usually used to carry cylindrical tools in order to perform different operations such as perforation, acidification, injection of anti-fouling, among others.

In the illustrated configuration, the flexitube acts with the purpose of transporting a laser tool (electronic device 4) for perforating wells, inside the well. In addition, optionally, the flexitube 20 is responsible for circulating the secondary fluid inside the heat exchanger vessel 3.

In the illustrated configuration, optionally the heat exchanger vessel 3 is in fluid communication with a flexitube 20, wherein the flexitube 20 is adapted to inject the secondary cooling fluid into the heat exchanger vessel 3.

Optionally, the heat exchanger vessel 3 comprises at least one opening 5 for fluid communication with the annulus 22 of the well, wherein the at least one opening 5 for fluid communication is adapted to allow the output of secondary cooling fluid of heat exchanger vessel 3.

Optionally, the communication between the flexitube 20 and the heat exchanger vessel is performed by a connecting element 21. The connecting element 21 can have different configurations, in which this does not represent a limitation to the scope of the invention.

The secondary cooling fluid adopted can be, for example, sea water at room temperature (close to 22° C.) or else, some externally cooled fluid. This choice can be made in each application of the invention.

It is emphasized that the prior art flexitubes already comprise the function of injecting sea water into the annulus 22 of a well, wherein the injected water can be entirely directed to the heat exchanger vessel 3, or else, part it can also be directed to the annulus 22.

Thus, the operation of the cooling system of the downhole electronic device 4 is as follows, a secondary cooling fluid is injected into the heat exchanger vessel 3, this fluid exchanges heat with the first heat exchanger element 1, cooling the primary cooling fluid that circulates through the first heat exchanger element 1.

The secondary fluid is then directed to the annulus 22 of the well through the at least one fluid communication opening 5 of the heat exchanger vessel 3. Thereafter, the secondary fluid can be recovered in a surface drilling rig.

Thus, the primary cooling fluid is cooled and directed to the second heat exchanger element 2 associated with the electronic device 4.

Preferably, when the electronic device 4 adopted is a laser device, the second heat exchanger element 2 is positioned on the structure of a laser diode 6 of the laser device 4. Thus, the cooling is carried out exactly at the point of greatest heat generation of the laser device 4, making the cooling much more efficient.

Optionally, a cooling fluid circulation line 7 adapted to provide the uninterrupted circulation of the first cooling fluid between the first 1 and the second 2 heat exchanger vessels is provided, wherein a pumping device 8 is also provided adapted to circulate the primary cooling fluid via cooling fluid circulation line 7.

Preferably, the circulation line 7 is of high thermal conductivity material to optimize heat exchange and improve the operation of the system of present invention.

Optionally, the pumping device 8 is positioned in electronic device 4, being integrated to this element.

Optionally, the first heat exchanger element 1 is a coil. However, any heat exchanger element can be adopted, so this feature does not represent a limitation on the scope of the present invention.

In an alternative configuration, the downhole electronic device cooling system can be fully integrated with electronic device 4. Alternatively, the heat exchanger vessel 3 can be coupled to the electronic device 4, which would facilitate any cleaning and maintenance operations on the heat exchanger vessel 3. It is emphasized that this feature does not represent a limitation to the scope of the present invention, wherein one skilled in the art will be able to determine the best configuration applied to each particular case.

Thus, the present invention provides an optimized downhole electronic device cooling system that does not find equivalence in the prior art.

Several variations focusing on the scope of protection of this application are permitted. Thus, it is emphasized the fact that the present invention is not limited to the particular configurations/embodiments described above.

The invention claimed is:

1. A cooling system for downhole electronic device comprising a first heat exchanger element internal to a heat exchanger vessel, and a second heat exchanger element associated with the electronic device, wherein the first and second heat exchanger elements are in fluid communication via a primary cooling fluid, wherein the heat exchanger vessel allows circulation of a secondary cooling fluid, wherein the heat exchanger vessel is in fluid communication with a flexitube, wherein the flexitube is adapted to inject the secondary cooling fluid into the heat exchanger vessel.

2. The system according to claim 1, wherein the communication between the flexitube and the heat exchanger vessel is carried out by a connector.

3. The system according to claim 2, characterized in that the heat exchanger vessel comprises at least one opening for fluid communication with the annulus of the well, wherein the at least one opening for fluid communication is adapted to allow the output of the secondary cooling fluid from the heat exchanger vessel.

4. The system according to claim 3, characterized in that the secondary cooling fluid comprises sea water at room temperature or a fluid cooled externally to the system.

5. The system as claimed in claim 3, further comprising: a cooling fluid circulating line adapted to provide uninterrupted circulation of the first cooling fluid between the first and the second heat exchanger vessels, and a pumping device adapted to circulate the primary cooling fluid via the cooling fluid circulating line.

6. The system according to claim 3, characterized in that the electronic device is a laser device.

7. The system according to claim 2, characterized in that the secondary cooling fluid comprises sea water at room temperature or a fluid cooled externally to the system.

8. The system as claimed in claim 2, further comprising: a cooling fluid circulating line adapted to provide uninterrupted circulation of the first cooling fluid between the first and the second heat exchanger vessels, and a pumping device adapted to circulate the primary cooling fluid via the cooling fluid circulating line.

9. The system according to claim 2, characterized in that the electronic device is a laser device.

10. The system according to claim 1, characterized in that the secondary cooling fluid comprises sea water at room temperature or a fluid cooled externally to the system.

11. The system as claimed in claim 10, further comprising: a cooling fluid circulating line adapted to provide uninterrupted circulation of the first cooling fluid between the first and the second heat exchanger vessels, and a pumping device adapted to circulate the primary cooling fluid via the cooling fluid circulating line.

12. The system according to claim 10, characterized in that the electronic device is a laser device.

13. The system as claimed in claim 1, further comprising: a cooling fluid circulating line adapted to provide uninterrupted circulation of the first cooling fluid between the first and the second heat exchanger elements, and a pumping device (8) adapted to circulate the primary cooling fluid via the cooling fluid circulating line.

14. The system according to claim 13, characterized in that the electronic device is a laser device.

15. The system according to claim 1, characterized in that the electronic device is a laser device.

16. The system according to claim 15, characterized in that the second heat exchanger element is positioned on a structure of a laser diode of the laser device.

* * * * *